US010638552B2

(12) United States Patent
Franco Gutierrez et al.

(10) Patent No.: US 10,638,552 B2
(45) Date of Patent: Apr. 28, 2020

(54) STOVETOP DEVICE

(71) Applicant: BSH Hausgeräte GmbH, Munich (DE)

(72) Inventors: Carlos Franco Gutierrez, Saragossa (ES); Teresa Del Carmen Marzo Alvarez, Saragossa (ES); David Paesa García, Saragossa (ES); Beatriz Villanueva Valero, Teruel (ES)

(73) Assignee: BSH Hausgeräte GmbH, Munich (DE)

( * ) Notice: Subject to any disclaimer, the term of this patent is extended or adjusted under 35 U.S.C. 154(b) by 898 days.

(21) Appl. No.: 15/039,037

(22) PCT Filed: Dec. 4, 2014

(86) PCT No.: PCT/IB2014/066576
§ 371 (c)(1),
(2) Date: May 25, 2016

(87) PCT Pub. No.: WO2015/087208
PCT Pub. Date: Jun. 18, 2015

(65) Prior Publication Data

US 2017/0181228 A1 Jun. 22, 2017

(30) Foreign Application Priority Data

Dec. 11, 2013 (ES) ..... 201331810

(51) Int. Cl.
*H05B 6/06* (2006.01)
*H05B 1/00* (2006.01)
*H05B 1/02* (2006.01)

(52) U.S. Cl.
CPC ..... *H05B 6/062* (2013.01); *H05B 1/0266* (2013.01); *H05B 2213/03* (2013.01); *H05B 2213/05* (2013.01); *H05B 2213/07* (2013.01)

(58) Field of Classification Search
CPC .. H05B 1/0266; H05B 6/062; H05B 2213/07; H05B 2213/05; H05B 2213/03
USPC ..... 219/620–627, 600, 632, 660, 663, 664, 219/667
See application file for complete search history.

(56) References Cited

U.S. PATENT DOCUMENTS

| | | | | |
|---|---|---|---|---|
| 2011/0168694 | A1* | 7/2011 | Sadakata | H05B 6/062 219/624 |
| 2012/0024840 | A1 | 2/2012 | Lee et al. | |
| 2013/0112683 | A1* | 5/2013 | Hegedis | A47J 27/62 219/660 |

FOREIGN PATENT DOCUMENTS

| | | | |
|---|---|---|---|
| EP | 2252130 | A1 | 11/2010 |
| EP | 2268101 | A1 | 12/2010 |
| EP | 2800453 | A1 | 11/2014 |
| WO | 9737515 | | 10/1997 |

(Continued)

OTHER PUBLICATIONS

International Search Report PCT.IB2014/066576 dated Jun. 21, 2016.

*Primary Examiner* — Quang T Van
(74) *Attorney, Agent, or Firm* — Michael E. Tschupp; Andre Pallapies; Brandon G. Braun

(57) ABSTRACT

A stovetop device includes a heating area adapted to heat cookware placed thereon and/or food to be cooked thereon, and a control unit configured to operate at least one subarea of the heating area in at least one operating state as at least one target temperature burner and to assign different target temperatures to different positions of the at least one target temperature burner.

18 Claims, 2 Drawing Sheets

(56) References Cited

FOREIGN PATENT DOCUMENTS

WO 2013118027 A1 8/2013

* cited by examiner

STOVETOP DEVICE

CROSS-REFERENCES TO RELATED APPLICATIONS

This application is the U.S. National Stage of International Application No. PCT/IB2014/066576, filed Dec. 4, 2014, which designated the United States and has been published as International Publication No. WO 2015/087208 and which claims the priority of Spanish Patent Application, Serial No. P201331810, filed Dec. 11, 2013, pursuant to 35 U.S.C. 119(a)-(d).

BACKGROUND OF THE INVENTION

A stovetop device with heating elements that are disposed in the form of a matrix is already known from the prior art. In said device the heating elements define a heating area for heating cookware placed thereon. The stovetop device also includes a control unit which, when cookware is placed on the heating area, assigns a heating zone to the cookware placed thereon. As a function of an operating input by means of an operating unit, the control unit assigns a heating power to the heating zone formed, independently of a position of the heating zone on the heating area, especially a heating power density and/or heating power level.

BRIEF SUMMARY OF THE INVENTION

The object of the invention especially consists in providing a generic device with improved properties in respect of advantageous heating. In accordance with the invention, the object is achieved by the features of independent claim, while advantageous embodiments and developments of the invention can be taken from the subclaims.

A stovetop device, especially an induction stovetop device, is proposed with a heating area which is intended for heating cookware placed thereon and/or food to be cooked placed thereon, and with a control unit, which is intended to operate at least one subarea of the heating area in at least one operating state as at least one target temperature burner and to assign different target temperatures to different positions of the at least one target temperature burner. A "stovetop device" is especially to be understood as at least a part, especially a submodule, of a stovetop, especially of an induction stovetop, wherein in particular accessory units for the stovetop can also be included, such as a sensor unit for external measurement of a temperature of an item of cookware and/or of food to be cooked for example. In particular, the stovetop device can also comprise the entire stovetop, in particular the entire induction stovetop. A "heating area" is especially to be understood as an advantageously two-dimensional area, which is intended to have cookware placed on it and/or food to be cooked placed on it, especially in order to heat the cookware placed on it and/or the food to be cooked placed on it. The heating area is advantageously delimited below in an installed position by a stovetop plate, especially in the direction of gravity. The stovetop device especially comprises a number of heating elements, which are preferably disposed in a matrix and which are especially intended, in the at least one operating state, to supply the heating area with an energy needed for heating cookware placed thereon and/or food to be cooked placed thereon. A "stovetop plate" is especially to be understood as an element, which is intended, in an installed position, to support cookware and/or food to be cooked placed on the heating area. A "control unit" is especially to be understood as an electronic unit, which is preferably integrated at least partly into a control and/or regulation unit of a stovetop, especially of an induction stovetop, and which is preferably intended to control and/or regulate at least the heating area. Preferably the control unit includes a processing unit and, in addition to the processing unit, especially a memory unit with a control and/or regulation program stored therein, which is intended to be executed by the processing unit. Advantageously the stovetop device has a detection unit, which especially can be formed by the heating elements themselves, which is intended to detect cookware placed thereon, especially by measuring a quality factor. Here the control unit is especially intended, by means of activation of at least one of the heating elements, especially at least a majority of and advantageously all of the heating elements, to at least make possible a detection by the detection unit of an item of cookware placed thereon. The control unit is especially intended to evaluate measured values of the detection unit, to calculate at least one heating zone and to define heating elements that form this heating zone. In particular the control unit is intended to assign a heating zone at least largely adapted in shape, size and/or position to a detected item of cookware. As an alternative, further possibilities appearing sensible to a person skilled in the art for detection of cookware placed on the stovetop are conceivable. A "target temperature burner" is especially to be understood as an especially two-dimensional area, to which at each coordinate, especially at each point, a target temperature, especially for the case of cookware and/or food to be cooked located at the point, is assigned. A "coordinate" is especially to be understood as a point of an especially two-dimensional, especially Cartesian coordinate system, which is especially exactly defined by specifying precisely two values. A "target temperature" is especially to be understood as a temperature to be achieved, advantageously a temperature aimed for in a heating mode. The control unit is especially intended, in the at least one operating state, to control and/or to regulate a heating power of the heating elements, especially by activating at least one rectifier, in order to reach the target temperature. Preferably the control unit is intended, in the at least one operating state, to adjust the target temperature by variation of the heating power of the heating elements, wherein the heating power of the heating elements is especially not regulated to a target heating power, but is advantageously embodied variably. The control unit is preferably intended, in the at least one operating state, to adapt an actual temperature of at least one point of the heating area to the target temperature of this at least one point in accordance with the target temperature burner. The expression that the control unit is intended to "operate" at least one subarea of the heating area as at least one target temperature burner in at least one operating state, is especially to be understood as the control unit being intended to activate at least one inverter in the at least one operating state, which especially, as a function of an activation by the control unit, supplies at least one of the heating elements with electrical energy. The expression that the control unit is intended "to operate" at least one subarea of the heating area "as at least one target temperature burner" in at least one operating state is especially to be understood as the control unit being intended, in the at least one operating state, to operate positions of the heating area covered by cookware and/or food to be cooked placed thereon, especially to supply them with electrical energy, especially in order to reach the set target temperatures of the covered positions. Here especially precisely one position of the heating area can be covered by the cookware and/or food to be cooked placed thereon. As an alternative a number of positions of the heating area could be covered by cookware and/or food to be cooked placed thereon, wherein this number of positions could essentially have this same target temperature or different target temperatures. The expression that the control unit is intended "to assign" different target temperatures to different positions of the at least one target temperature burner is especially to be understood as the control unit being intended, in the at least one operating state, to control and/or regulate a quantity of energy supplied to the heating area, especially by means of the heating elements, in order to heat to the target temperature cookware placed at different positions of the heating area and/or the food located in the cookware and/or food placed on the stovetop and/or to maintain it at the target temperature. Various options appearing sensible to a person skilled in the art are conceivable for assigning different target temperatures to the different positions of the at least one target temperature burner. For example the control unit could be intended to assign different target temperatures to the different positions of the at least one target temperature burner by means of tables and/or algorithms. Furthermore stored, especially predefined values could be employed, wherein different stored values of the target temperatures would be assigned to the different positions of the at least one target temperature burner. Preferably however the control unit is intended to assign different target temperatures to the different positions of the at least one target temperature burner by means of an especially two-dimensional mathematical function. A "mathematical function" is especially to be understood as a mapping that establishes a relationship between the target temperatures and the coordinates and advantageously assigns a target temperature to each coordinate. The mathematical function of the target temperature can especially be expressed by T(x, y). Different embodiments of the mathematical function appearing sensible to a person skilled in the art are conceivable. For example the mathematical function could be a stepped function, wherein especially a graph along at least one axis of the coordinate system could be embodied in a stepped shape. Here the mathematical function especially has different temperature sections, which especially extend in parallel to a plane spanned by the x-axis and the y-axis. It is further conceivable for the mathematical function to have a function changing constantly and advantageously at least essentially continuously in its value, especially along at least one axis of the coordinate system. A linear or exponential change is especially conceivable here. Preferably the control unit, in the at least one operating state, outputs by means of a display unit that is advantageously integrated into an operating unit a subdivision and/or a graph of the at least one target temperature burner, especially to an operator. "Different" is to be understood as especially differing in one feature and/or advantageously differing. "Intended" is to be understood as specifically programmed, designed and/or equipped. The fact that an object is intended for a specific function is especially to be understood as the object fulfilling and/or executing this specific function in at least one application state and/or operating state.

The inventive embodiment especially enables an advantageous heating of cookware and/or food to be cooked placed on the stovetop to be achieved. A target temperature of the item of cookware and/or food to be cooked especially desired by an operator can advantageously be reached exactly, especially by placing the cookware and/or putting the food to be cooked in at least one position, to which the desired target temperature is assigned. Advantageously this enables greater operating convenience and/or simple operation of the stovetop device to be achieved, wherein especially by moving the cookware, a temperature of the cookware and/or food to be cooked can be changed. In addition an alternative to a setting of a target heating power can advantageously be provided.

It is further proposed that the control unit has a memory unit in which at least two different target temperature burners are stored, which especially enables a high flexibility to be achieved.

For example it is conceivable for the control unit to be intended, as a function of a characteristic cookware value, especially a position and/or a material and/or a type of cookware and/or food to be cooked placed on the stovetop, to use different target temperature burners. Furthermore the control unit could be intended, as a function of an energy supply, to use different target temperature burners. In particular it is conceivable for the control unit to be intended, as a function of a movement of cookware and/or of food to be cooked placed on the stovetop, to use different target temperature burners. Preferably however the control unit is intended, in the at least one operating state, as a function of an operator entry by means of an operating unit, to switch between at least two target temperature burners, especially between the at least two different target temperature burners stored in the control unit, wherein the control unit is especially intended to deactivate a first of the at least two target temperature burners and to a activate a second of the at least two target temperature burners. This especially enables a high flexibility and/or high operator convenience to be achieved.

Furthermore it is proposed that the control unit is intended, in the at least one operating state, as a function of an operator entry by means of an operating unit, to modify the at least one target temperature burner, especially in relation to at least one property of the at least one target temperature burner. The control unit could especially be intended to change a graph of the at least one target temperature burner, advantageously of the mathematical function that describes the at least one target temperature burner, such as for example a width of temperature sections of the at least one target temperature burner and/or at least one gradient of an at least essentially continuous graph of the at least one target temperature burner. Furthermore the control unit could advantageously be intended to change at least one target temperature of the at least one target temperature burner, especially in at least one temperature section. Furthermore it is conceivable for the control unit to be intended to change all target temperatures of the target temperature burner in parallel by a constant value or by a specific percentage value. In addition further modifications to the at least one target temperature burner appearing sensible to the person skilled in the art are conceivable. This especially enables an advantageous interaction between an operator and the control unit and thus in particular a high level of convenience for the operator to be achieved.

It is further proposed that the control unit is intended, in the at least one operating state, as a function of an operator entry by means of an operating unit, to make it possible to form at least one further target temperature burner and advantageously to store the at least one further target temperature burner in the memory unit of the control unit. Various options for forming the at least one further target temperature burner appearing sensible to a person skilled in the art are conceivable. For example the operator could enter a mathematical function of the at least one further temperature burner by an operator entry by means of the operating unit. As an alternative or in addition the operator could enter at least two, especially at least four, advantageously a plurality of coordinates of the at least one further target temperature burner, wherein the control unit could especially be intended to store the coordinates in the memory unit and advantageously to use the coordinates for operating the heating area as the at least one further target temperature burner, especially as table values and/or advantageously as a fitted mathematical function. It is likewise conceivable for the control unit to be intended by the operator, by means of an operator entry by means of the operating unit, to link recorded contours to the at least one further target temperature burner. This especially enables a high flexibility and/or high convenience for the operator to be achieved.

It is additionally proposed that the control unit is intended to carry out at least two different cooking methods, which can especially be stored in the memory unit, and in the at least one operating state, in different methods of the at least two cooking methods, to assign different target temperatures to the same positions of the at least one target temperature burner. The at least two different cooking methods are advantageously frying and boiling. In addition the at least two different cooking methods could especially be poaching and/or simmering and/or steaming and/or blanching and/or deep frying and/or stewing and/or pressure cooking and/or sautéing and/or grilling and/or roasting. In addition further cooking methods appearing sensible to a person skilled in the art are conceivable. This especially enables any type of food for cooking to be cooked in the optimum way.

It is further proposed that the stovetop device has at least one first sensor unit, which has a measurement point in an area close to the base of the cookware, and has at least one second sensor unit, which has a measurement point above the base of the cookware, especially at least 10 mm above it, preferably at least 15 mm above it and especially preferably at least 20 mm above it, wherein advantageously each sensor unit is assigned to one of the at least two different cooking methods. The at least one first sensor unit is especially intended, in the at least one operating state, to detect a temperature of the cookware base and/or especially of the stovetop by means of the measurement point. A "sensor unit" is especially to be understood as a unit that is intended, in the at least one operating state, to detect a temperature, especially an actual temperature of cookware placed on the stovetop and/or of food to be cooked, especially food located in the cookware. Various sensor units appearing sensible to the person skilled in the art are conceivable. For example the at least one sensor unit could have at least one heat-dependent resistance. In addition the at least one sensor unit could have at least one sensor, such as for example a heating element and/or a coil, which could be intended to detect at least one heat-dependent electrical characteristic value. Furthermore sensor units based on infrared measurement are conceivable. An "area close to" an object is especially to be understood as an area of which the points are at a distance of less the 10 mm, especially of less than 8 mm and advantageously of less 5 mm from the object, especially at least in a direction aligned in parallel to the direction of gravity in an installed position. This especially enables a high flexibility to be achieved.

It is further proposed that the control unit is intended, as a function of an operator entry by means of an operating unit, to switch between the at least one operating mode in which the heating area is operated as the at least one target temperature burner, and at least one further operating mode in which the heating area is operated classically, and especially additionally at least one second operating mode, in which the heating area is operated as at least one target heating power burner. The expression that the heating area is operated "classically" is especially to be understood as the control unit being intended, in the further operating mode, to assign at least one heating zone to cookware and/or food to be cooked placed on the stovetop and especially by means of at least one output unit, which can advantageously be integrated into the operating unit, to output a request for an operator to enter a heating power, especially a heating power level and/or a heating power density and advantageously, after entry of the heating power for the at least one heating zone, to operate the at least one heating zone with the entered heating power. This especially enables a plurality of possible operating modes to be provided. In addition a convenient interaction between the operator and the control unit can advantageously be achieved.

Further advantages emerge for the description of the figures given below. Shown in the drawing is an exemplary embodiment of the invention. The drawing, the description and the claims contain numerous features in combination. The person skilled in the art will expediently also consider the features individually and group them into sensible further combinations.

DETAILED DESCRIPTION OF EXEMPLARY EMBODIMENTS OF THE PRESENT INVENTION

Figure 1:
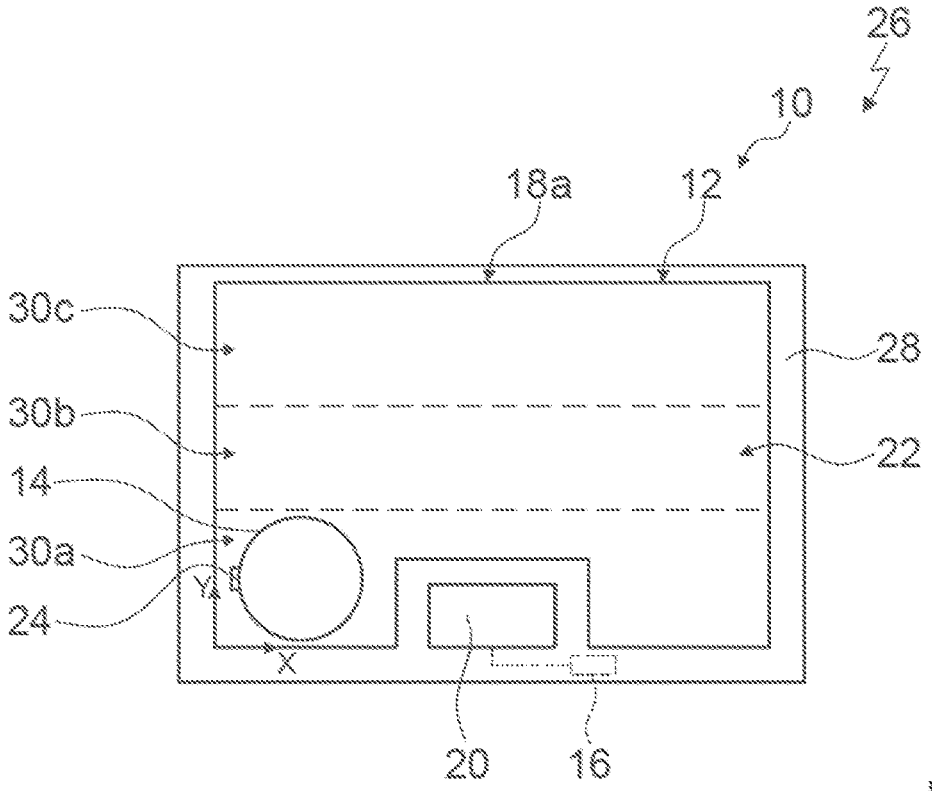
FIG. 1 shows a stovetop with an inventive stovetop device in a first activated state in a schematic view from above.
Figure 2:
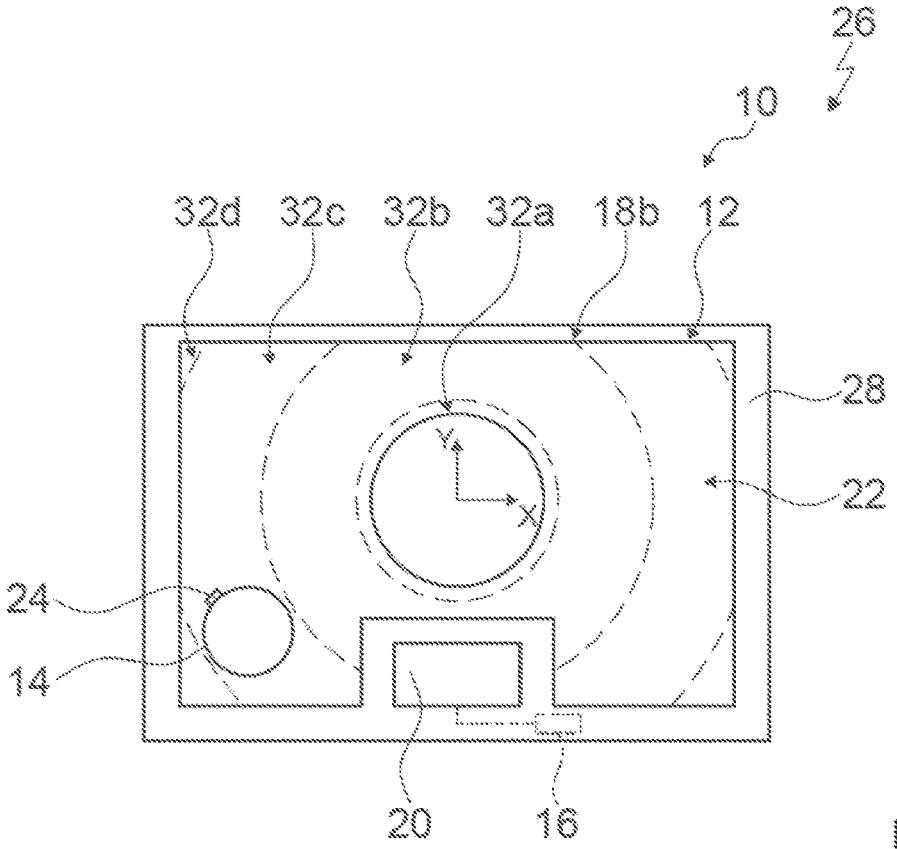
FIG. 2 shows the stovetop device in a second activated state in a schematic view from above.

FIG. 1 shows a stovetop 26, which is embodied as an induction stovetop, with a stovetop device 10, which is embodied as an induction stovetop device. The stovetop device 10 has a stovetop plate 28 for placing cookware 14 thereon. In addition the stovetop device 10 has a number of heating elements (not shown) for the generation of energy. The heating elements, which in the present case are embodied as induction heating elements, are disposed underneath the stovetop plate 28 in an installed position. In an assembled state the heating elements are arranged in the shape of a matrix. As an alternative to a matrix it is conceivable for the heating elements to be embodied as movably-supported heating elements and to be intended to be moved below the stovetop plate and in directions disposed essentially in parallel to the stovetop plate.

The stovetop device 10 comprises a heating area 12 for heating cookware 14 placed thereon. As an alternative or in addition the heating area is intended for heating food to be cooked placed thereon, wherein for example in the installed position at least one Teriyaki plate could be placed on top of the heating area 12 and especially on top of the stovetop plate 28 and wherein in the installed position food to be cooked could especially be placed on top of the at least one Teriyaki plate. Here the heating area 12 could be intended for heating up food to be cooked placed on top of the at least one Teriyaki plate. In the installed position and in an activated state, the heating elements supply energy to the heating area 12 at least at positions of cookware 14 placed thereon for heating the cookware 14 placed thereon, especially in the form of electromagnetic burners. In the activated state, by means of energy generated by the heating elements, the heating area 12 heats cookware 14 placed on the stovetop plate 28 above the heating area 12. For detection of cookware 14 placed on the stovetop the stovetop device 10 comprises a detection unit (not shown). The detection unit is embodied at least partly in one piece with the heating elements and is intended, by means of a measurement known per se, to detect at least one quality factor for cookware 14 placed thereon. As an alternative further embodiments of a detection unit appearing sensible to a person skilled in the art are conceivable.

For detection of a temperature the stovetop device 10 comprises a number of first sensor units 22 and a number of second sensor units 24. In the present exemplary embodiment the stovetop device 10 comprises a second sensor unit 24 for each item of cookware 14. For each heating element the stovetop device 10 comprises a first sensor unit 22. As an alternative a ratio of first sensor units and heating elements in an area could lie between one to three and four to one. Likewise conceivable is another number of first sensor units and/or second sensor units appearing sensible to a person skilled in the art. Only one of the first sensor units 22 and one of the second sensor units 24 is considered below. The other first sensor units 22 and second sensor units 24 are accordingly embodied identically.

A first sensor unit could especially be disposed essentially within an item of cookware placed on the stovetop, especially in an area close to the base of an item of cookware placed on stovetop. Furthermore a first sensor unit could be disposed on an outer wall of an item of cookware placed on the stovetop, especially in an area close to the base of the cookware. However the first sensor unit 22 is disposed below the stovetop plate 28. Here the first sensor unit 22 is disposed on a side of the stovetop plate 28 facing away from the cookware 14 placed on the stovetop plate. The first sensor unit 22 is disposed in an area close to the heating element assigned to the first sensor unit 22. By means of infrared radiation the first sensor unit 22, which has an infrared sensor, detects a temperature of the base of the cookware through the stovetop plate 28. The first sensor unit 22 accordingly has a measurement point in an area close to the base of the cookware and especially directly on the base of the cookware. The first sensor unit 22 thus detects a temperature of the base of the cookware of the cookware 14.

A second sensor unit could especially be disposed essentially within an item of cookware placed on the stovetop, especially in direct contact with food to be cooked located in the cookware placed on the stovetop and especially at a distance of at least 10 mm from a base of the cookware. Furthermore a second sensor unit could be disposed within a preferably movably-supported component, especially a dome, wherein the movably-supported component could be disposed outside an activated state, especially below a stovetop plate. Here the movably-supported component could be moved by actuation, especially by a pressure force exerted by an operator, into a position above the stovetop plate, in order especially to make it possible for a measurement to be made by the second sensor unit, advantageously by means of infrared radiation. The movably-supported component could especially be disposed in an area close to an edge of the stovetop plate. In the present exemplary embodiment the second sensor unit 24 is partly disposed above the stovetop plate 28. Here the second sensor unit 24 is disposed on the same side of the stovetop plate 28 as the cookware 14 disposed thereon. The second sensor unit 24 has a measurement point above the base of the cookware, and indeed at a distance of at least 10 mm above the base of the cookware. The second sensor unit 24 detects a temperature of an outer wall of the cookware 14, which at least essentially corresponds to a temperature of food being cooked that is located in the cookware 14. In the assembled state the second sensor unit 24 is disposed externally on a side wall of the cookware 14 placed on the stovetop. This could for example be done by means of a magnet and/or suction knob. As an alternative further attachment options appearing sensible to a person skilled in the art are conceivable.

As an alternative to the embodiment with first sensor units 22 and second sensor units 24, an embodiment with precisely one sensor unit is conceivable, wherein the sensor unit could especially be embodied similarly to the first sensor unit 22. Here the control unit would especially be intended to use the temperature of the cookware base detected by the sensor unit for an estimation of a temperature of food being cooked that is located in the cookware.

In an area facing towards an operator in the installed position the stovetop device 10 comprises an operating unit 20 for entry of operating commands. In the present exemplary embodiment the operating unit 20 has a touch screen. The stovetop device 10 further comprises a control unit 16, which performs actions and/or makes and/or changes settings as a function of the operator commands entered by means of the operating unit 20. In addition the control unit 16 is intended for control and regulation of the heating elements. Here the control unit 16 combines heating elements covered by cookware 14 placed thereon into heating zones, as a function of a detection of cookware 14 placed thereon by the detection unit. The control unit 16 operates the heating elements combined into heating zones.

In an operating state the control unit 16 operates a subarea 18*a-f* of the heating area 12 as target temperature burner (cf. FIGS. 1 to 4). Here the control unit 16 assigns different target temperatures to different positions of the target temperature burner. In the operating state the control unit 16 is intended, at the positions covered by cookware placed on the stovetop, to reconcile an actual temperature of the heating area 12 with the target temperature of the heating area 12. To this end the control unit 16 uses the temperatures detected by the sensor units 22, 24. Depending on the temperatures detected by the sensor units 22, 24, the control unit 16 regulates a heating power of the heating elements at positions covered by cookware placed on the stovetop, in order to adjust the target temperature of the heating area 12.

The control unit 16 has a memory unit (not shown) in which a number of different target temperature burners are stored. Only four of the target temperature burners are shown by way of example in FIGS. 1 to 4, wherein significantly more target temperature burners can be stored in the memory unit. In addition at least two different cooking methods are stored in the memory unit of the control unit 16. A first of the at least two cooking methods is frying. The first sensor unit 22 is assigned to the first cooking method. A second of the at least two cooking methods is boiling. The second sensor unit 24 is assigned to the second cooking method. By means of the operating unit 20 an operator can select between the at least two cooking methods in the operating state. In the operating state in different methods of the two different cooking methods, the control unit 16 assigns different target temperatures to the same positions of the target temperature burner. To reconcile an actual temperature with a target temperature of a position of the target temperature burner the control unit 16 uses the temperature detected by the first sensor unit 22 for the selected first cooking method. When the second cooking method is selected, the control unit 16 uses the temperature detected by the second sensor unit 24 to reconcile an actual temperature with a target temperature of the same position of the target temperature burner.

It is to be assumed below, without restricting general applicability, that one of the at least two cooking methods is selected. In a method for operating the stovetop device 10, a subarea 18*a-f* of the heating area 12 is operated in the operating state as a target temperature burner. The control unit 16 assigns a target temperature to each coordinate of the target temperature burner. In the operating state the control unit 16 operates a subarea 18*a-f* of the heating area 12 as a function of an operator entry by means of the operating unit 20 as one of the target temperature burners stored in the memory unit. As a function of an operator entry by means of the operating unit 20, the control unit 16 subdivides the heating area 12 into subareas 18*a-f*.

If exactly one subarea 18*a* is selected, the control unit 16 then operates the subarea 18*a* of the heating area 12 as a target temperature burner (cf. FIG. 1). Here the subarea 18*a* extends over essentially an entire extent of the heating area 12. For example, through an operator entry by means of the operating unit 20, a first target temperature burner is selected from the target temperature burners stored in the memory unit (cf. FIG. 1). An origin of the coordinate system is disposed at a corner of the heating area 12. An x-axis of the coordinate system extends in parallel to a front edge of the stovetop plate 28 facing towards an operator in the installed position. A y-axis of the coordinate system extends at right angles to the x-axis and in parallel to a plane spanned by the stovetop plate 28.

A mathematical function, which has a stepped function, is assigned to the first target temperature burner. The first target temperature burner has three target temperature sections 30*a*, 30*b*, 30*c*. The target temperature sections 30*a*, 30*b*, 30*c* are aligned as types of rows essentially in parallel to the x-axis. In addition the target temperature sections 30*a*, 30*b*, 30*c* are adjacent in the y-axis, especially adjoining one another. Each of the target temperature sections 30*a*, 30*b*, 30*c* is assigned a different target temperature. In the present exemplary embodiment a first of the target temperature sections 30*a*, which in the installed position is closest to an operator, is assigned a lowest target temperature. A third of the target temperature sections 30*c*, which in the installed position is at a greatest distance from the operator, is assigned a highest target temperature. Cookware 14 placed on the stovetop can be heated to different target temperatures by means of the target temperature sections 30*a*, 30*b*, 30*c* of the first target temperature burner.

As a function of an operating entry by means of the operating unit 20, the control unit 16 modifies the first target temperature burner. For example the control unit 16 could modify a target temperature of the target temperature sections 30*a*, 30*b*, 30*c*, wherein the control unit, as a function of an operating entry by means of the operating unit, could for example assign a lowest target temperature to the third temperature section 30*c* and a highest target temperature to the first temperature section 30*a*. As an alternative other distributions of the target temperature sections 30*a*, 30*b*, 30*c* appearing sensible to a person skilled in the art are conceivable. Furthermore a number and/or an extent, especially in the y-direction, of the target temperature sections 30*a*, 30*b*, 30*c* could be varied.

As a function of an operating entry by means of the operating unit 20 the control unit 16 switches in the operating state between the target temperature burners that are stored in the memory unit. For example an operator, starting from the first target temperature burner, by an operating entry by means of the operating unit 20, selects a second target temperature burner from the temperature burners stored in the memory unit (cf. FIG. 2). Then the control unit 16 deactivates the first target temperature burner and activates the second target temperature burner. A mathematical function, which has a stepped function, is assigned to the second target temperature burner. The second target temperature burner has target temperature sections 32*a*, 32*b*, 32*c*, 32*d*. The target temperature sections 32*a*, 32*b*, 32*c*, 32*d* are disposed concentrically to one another. A center point of each target temperature section 32*a*, 32*b*, 32*c*, 32*d* and a center point of the stovetop plate 28 essentially coincide. An origin of a coordinate system is placed in this case in the center point of the stovetop plate 28. A different target temperature is assigned to each of the target temperature sections 32*a*, 32*b*, 32*c*, 32*d*. Starting from the origin of the coordinate system, the target temperature of the target temperature sections 32*a*, 32*b*, 32*c*, 32*d* changes, especially decreases or increases essentially monotonously, wherein especially a target temperature section closest to the origin has a lower target temperature than a target temperature section lying further away from the origin. A number of items of cookware 14 placed at different positions can be heated up to different target temperatures especially at the same time by means of the target temperature sections 32*a*, 32*b*, 32*c*, 32*d* of the second target temperature burner.

In the operating state the control unit 16 makes it possible, as a function of an operator entry by means of the operating unit 20, to form further target temperature burners. After formation of one of the further target temperature burners the control unit 16 stores the further target temperature burner, as a function of an operator entry by means of the operating unit 20, in the memory unit of the control unit 16. For example the control unit, as a function of an operator entry by means of the operating unit, can make it possible to change an arrangement of target temperature sections. Here the control unit, as a function of an operator entry by means of the operating unit, can make possible a change in width and/or length of the target temperature sections. In addition, target temperature sections especially extending diagonally over a subarea of the heating area are conceivable, which are especially aligned at an angle to the x-axis and to the y-axis. In addition target temperature sections aligned in a circular shape are conceivable, of which the center points are disposed in a corner of the heating area. As an alternative or in addition, further arrangements and/or combinations of target temperature sections appearing sensible to a person skilled in the art are conceivable.

Figure 3:
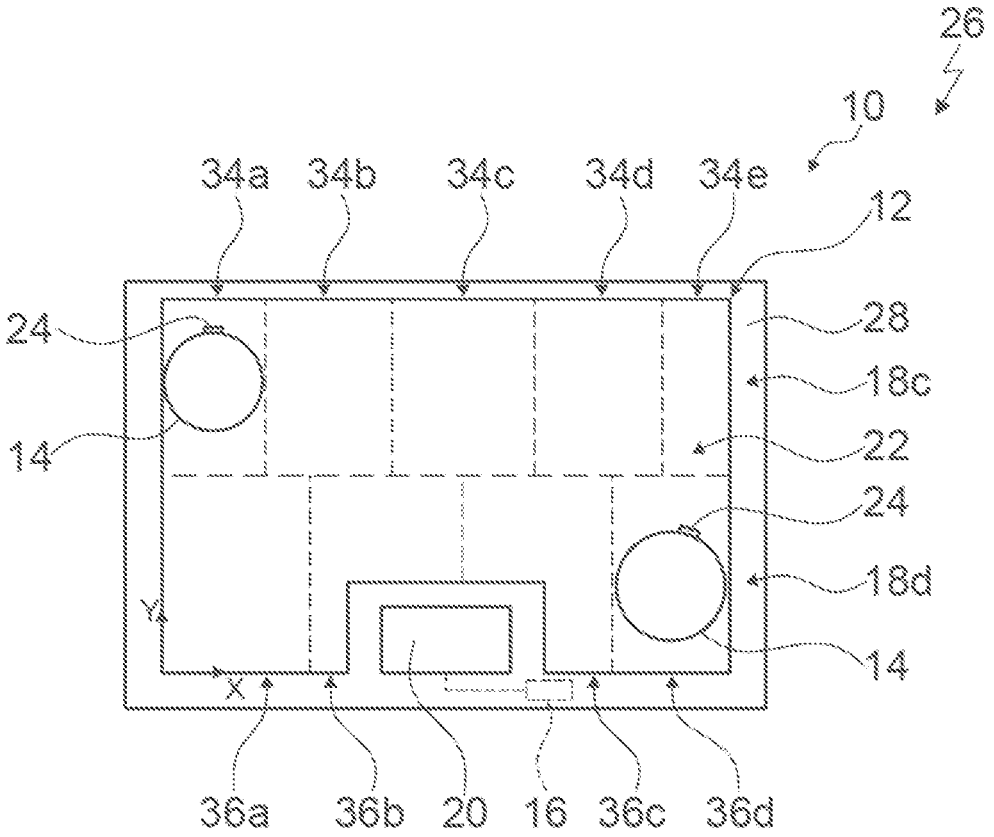
FIG. 3 shows the stovetop device in a third activated state in a schematic view from above.
Figure 4:
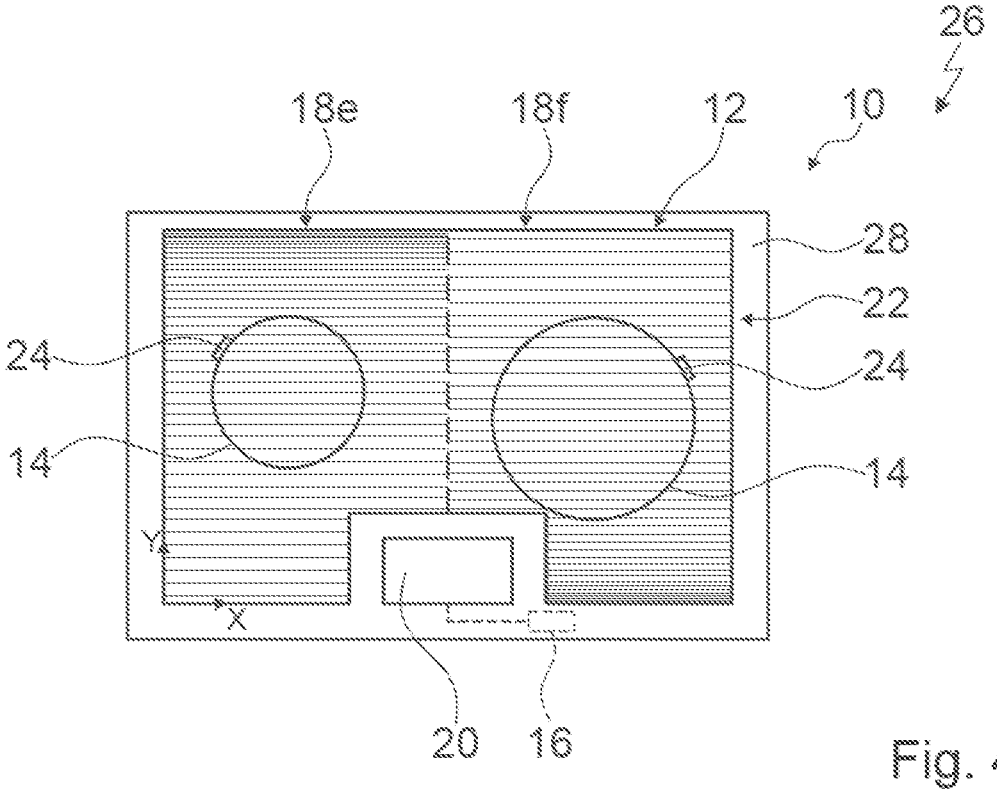
FIG. 4 shows the stovetop device in a fourth activated state in a schematic view from above.

If two subareas 18*c*, 18*d* are selected by an operator entry by means of the operating unit 20, then the control unit 16 operates each of the subareas 18*c*, 18*d* of the heating area 12 as a target temperature burner (cf. FIG. 3). In the present exemplary embodiment the subareas 18*c*, 18*d* are essentially the same size. The control unit 16, as a function of an operator entry by means of the operating unit 20, operates a first of the subareas 18*c* as the third target temperature burner and a second of the subareas 18*d* as the fourth target temperature burner. A mathematical function having a stepped function is assigned to the third and the fourth target temperature burner in each case. The third target temperature burner has five target temperature sections 34*a*, 34*b*, 34*c*, 34*d*, 34*e*. The fourth target temperature burner has four target temperature sections 36*a*, 36*b*, 36*c*, 36*d*. The target temperature sections 34*a*, 34*b*, 34*c*, 34*d*, 34*e*, 36*a*, 36*b*, 36*c*,

36*d* of the target temperature burners are each disposed aligned in the form of columns in parallel to the y-axis and are adjacent in the x-axis, especially adjoining one another. A different target temperature is assigned to each of the target temperature sections 34*a*, 34*b*, 34*c*, 34*d*, 34*e*, 36*a*, 36*b*, 36*c*, 36*d* of one of the target temperature burners.

In the operating state, as a function of an operator entry by means of the operating unit 20, the control unit 16 modifies a subdivision of the heating area 12 into subareas. For example the control unit 16, in the operating mode, as a function of an operator entry by means of the operating unit 20, divides the heating area 12 into two subareas 18*e*, 18*f* (cf. FIG. 4). The subareas 18*e*, 18*f* are each disposed aligned in the form of columns in parallel to the y-axis and are adjacent in the x-axis, especially adjoining one another. As a function of an operator entry by means of the operating unit 20 the control unit 16 operates each of the subareas 18*e*, 18*f* as a target temperature burner and assigns a mathematical function to each target temperature burner. The mathematical function has a function changing constantly and essentially continuously in its value along the y-axis. A first of the subareas 18*e* has essentially continuously rising values of the target temperature in the y-axis. A second of the subareas 18*e*, 18*f* has essentially continuously falling values of the target temperature in the y-axis.

As a function of an operator entry by means of the operating unit 20, the control unit 16 switches between the operating mode in which the heating area 12 is operated as a target temperature burner, and a further operating mode in which the heating area 12 is operated classically. When cookware 14 is placed on the stovetop the control unit 16 assigns a heating zone to the cookware 14 placed thereon in the further operating mode. Before the cookware 14 placed on the stovetop is heated, the control unit 16, in the further operating mode, outputs an operating request for an operator entry by means of the operating unit 20 to enter a heating power for the newly placed cookware 14. After the operator entry has been made by means of the operating unit 20 the control unit 16 operates the newly placed cookware 14 in the further operating mode with the heating power entered via the operating unit 20. As an alternative or in addition, a regulation mode for reaching a predetermined target temperature is also conceivable.

As an alternative or in addition to a touch screen, further different embodiments of the operating unit appearing sensible to a person skilled in the art are conceivable. For example the operating unit could have a control knob or a touch slider. Furthermore it is conceivable for the operating unit to be embodied partly in one piece with a stovetop plate, wherein especially operating commands and advantageously an arrangement of temperature sections of at least one target temperature burner could be made by means of an operator entry via a surface of the stovetop plate. In addition any combinations of the described embodiments appearing sensible to the person skilled in the art are conceivable.

REFERENCE CHARACTERS

10 Stovetop device
12 Heating area
14 Cookware
16 Control unit
18 Subarea
20 Operating unit
22 First sensor unit
24 Second sensor unit
26 Stovetop
28 Stovetop plate
30 Target temperature section
32 Target temperature section
34 Target temperature section
36 Target temperature section

The invention claimed is:

1. A stovetop device, comprising:

a heating area adapted to heat cookware placed thereon;

a plurality of heating elements disposed in a matrix across the heating area, wherein each heating element comprises a detection unit configured to detect cookware placed thereon;

a plurality of temperature sensors associated with the plurality of heating elements and configured to sense a temperature of the cookware; and a control unit configured to operate at least one subarea of the heating area by regulating a respective heating power of each of the plurality of heating elements in the subarea, the control unit further configured to selectively transition between a first operating state and a second operating state;

wherein the first operating state includes different target temperatures to different positions of a target temperature field corresponding to the subarea, and regulating the respective heating power of one or more of the heating elements to reconcile an actual temperature of cookware placed on the subarea with the target temperature of the target temperature field; and wherein the second operating state includes automatically defining a heating zone corresponding to a detected cookware item, and applying a same heating power to the heating elements of the heating zone.

2. The stovetop device of claim 1, constructed in the form of an induction stovetop device.

3. The stovetop device of claim 1, wherein the control unit has a memory unit configured to store at least two different target temperature fields.

4. The stovetop device of claim 1, further comprising an operating unit, said control unit being configured to switch, in the first operating state, between at least two predefined target temperature fields as a function of an operator entry via the operating unit.

5. The stovetop device of claim 1, further comprising an operating unit, said control unit being configured to modify the target temperature field, in the first operating state, as a function of an operator entry via the operating unit.

6. The stovetop device of claim 1, further comprising an operating unit, said control unit being configured to enable formation of at least one further target temperature field in the first operating state, as a function of an operator entry via the operating unit.

7. The stovetop device of claim 1, wherein the control unit is configured to carry out at least two different cooking methods and to assign different target temperatures to same positions of the target temperature field in the first operating state in different methods of the at least two different cooking methods.

8. The stovetop device of claim 1, further comprising at least one first temperature sensor unit having a measurement point in an area close to a base of an item of cookware, and at least one second temperature sensor unit having a measurement point above the base of the item of cookware.

9. The stovetop device of claim 1, wherein the first operating mode further comprises assigning target temperatures to the target temperature field based on a mathematical function having a constantly changing value with respect to an axis.

10. A stovetop, comprising at least one stovetop device which includes a heating area adapted to heat cookware placed thereon;

a plurality of heating elements disposed in a matrix across the heating area, wherein each heating element comprises a detection unit configured to detect cookware placed thereon;

a plurality of infrared temperature sensors associated with the plurality of heating elements and configured to sense a temperature of the cookware; and a control unit configured to operate at least one subarea of the heating area by regulating a respective heating power of each of the plurality of heating elements in the subarea, the control unit further configured to selectively transition between a first operating state and a second operating state;

wherein the first operating state includes assigning different target temperatures to different positions of a target temperature field corresponding to the subarea, and regulating the respective heating power of one or more of the heating elements to reconcile an actual temperature of cookware placed on the subarea with the target temperature of the target temperature field; and wherein the second operating state includes automatically defining a heating zone corresponding to a detected cookware item, and applying a same heating power to the heating elements of the heating zone.

11. The stovetop of claim 10, constructed in the form of an induction stovetop.

12. The stovetop of claim 10, wherein the control unit has a memory unit configured to store at least two different target temperature fields.

13. The stovetop of claim 10, wherein the stovetop device includes an operating unit, said control unit being configured to switch, in the first operating state, between at least two predefined target temperature fields as a function of an operator entry via the operating unit.

14. The stovetop of claim 10, wherein the stovetop device includes an operating unit, said control unit being configured to modify the target temperature field, in the first operating state, as a function of an operator entry via the operating unit.

15. The stovetop of claim 10, wherein the stovetop device includes an operating unit, said control unit being configured to enable formation of at least one further target temperature field in the at least one operating state, as a function of an operator entry via the operating unit.

16. The stovetop of claim 10, wherein the control unit is configured to carry out at least two different cooking methods and to assign different target temperatures to same positions of the target temperature field in the at least one first operating state in different methods of the at least two different cooking methods.

17. The stovetop of claim 10, wherein the stovetop device includes at least one first temperature sensor unit having a measurement point in an area close to a base of an item of cookware, and at least one second temperature sensor unit having a measurement point above the base of the item of cookware.

18. The stovetop of claim 10, wherein the first operating mode further comprises assigning target temperatures to the target temperature field based on a mathematical function having a constantly changing value with respect to an axis.

* * * * *